US009151292B2

(12) United States Patent
Huang et al.

(10) Patent No.: US 9,151,292 B2
(45) **Date of Patent: *Oct. 6, 2015**

(54) SCREW COMPRESSOR WITH A SHUNT PULSATION TRAP

(75) Inventors: Paul Xiubao Huang, Fayetteville, GA (US); Sean William Yonkers, Peachtree City, GA (US)

(73) Assignee: HI-BAR BLOWERS, INC., Fayetteville, GA (US)

( * ) Notice: Subject to any disclaimer, the term of this patent is extended or adjusted under 35 U.S.C. 154(b) by 356 days.

This patent is subject to a terminal disclaimer.

(21) Appl. No.: 13/340,592

(22) Filed: Dec. 29, 2011

(65) Prior Publication Data

US 2012/0171069 A1 Jul. 5, 2012

Related U.S. Application Data

(60) Provisional application No. 61/430,139, filed on Jan. 5, 2011.

(51) Int. Cl.
*F03C 2/00* (2006.01)
*F03C 4/00* (2006.01)
(Continued)

(52) U.S. Cl.
CPC ..... *F04C 18/16* (2013.01); *F04B 11/00* (2013.01); *F04B 39/0055* (2013.01);
(Continued)

(58) Field of Classification Search
CPC ..... F04C 2/16; F04C 2/18; F04C 18/16; F04C 29/04; F04C 29/065; F04C 29/068; F04B 39/0061; F04B 29/0055; F04B 11/00; F04B 39/0055
USPC ..... 418/15, 85–86, 180–181, 201.1, 201.2; 417/312, 540
See application file for complete search history.

(56) References Cited

U.S. PATENT DOCUMENTS 2,489,887 A * 11/1949 Houghton ..... 418/86
4,215,977 A 8/1980 Weatherston
(Continued)

FOREIGN PATENT DOCUMENTS

JP 60252117 12/1985
JP 01032085 A * 2/1989 ..... 418/15
(Continued)

OTHER PUBLICATIONS

JP 07-332273A—Tomika—Casing Structure for Compressor—Dec. 22, 1995—English Machine Translation.*

*Primary Examiner* — Theresa Trieu
(74) *Attorney, Agent, or Firm* — Gardner Groff Greenwald & Villanueva, P.C.

(57) ABSTRACT

A shunt pulsation trap for a screw compressor reduces gas pulsation and NVH, and improves off-design efficiency, without using a traditional serial pulsation dampener and a sliding valve. A screw compressor has a pair of multi-helical-lobe rotors that are housed in a compressor chamber that propel gas flow from a suction port to a discharge port of the compressor chamber. The shunt pulsation trap includes an inner casing as an integral part of the compressor chamber, and an outer casing oversized and surrounding the inner casing. The shunt pulsation trap houses at least one gas pulsation dampening device, and includes at least one injection port (trap inlet) branching off from the compressor chamber into the pulsation trap chamber and a feedback region (trap outlet) communicating with the compressor outlet.

19 Claims, 14 Drawing Sheets

(51) Int. Cl.

| | |
|---|---|
| ***F04C 18/00*** | (2006.01) |
| ***F04C 18/16*** | (2006.01) |
| ***F04C 2/18*** | (2006.01) |
| ***F04C 2/16*** | (2006.01) |
| ***F04B 11/00*** | (2006.01) |
| ***F04C 29/04*** | (2006.01) |
| ***F04B 39/00*** | (2006.01) |
| ***F04C 18/08*** | (2006.01) |
| ***F04C 29/00*** | (2006.01) |
| ***F04C 29/06*** | (2006.01) |

(52) U.S. Cl.

CPC ..... *F04B 39/0061* (2013.01); *F04C 2/16* (2013.01); *F04C 2/18* (2013.01); *F04C 18/086* (2013.01); *F04C 29/0014* (2013.01); *F04C 29/0035* (2013.01); *F04C 29/04* (2013.01); *F04C 29/065* (2013.01); *F04C 29/068* (2013.01); *F04C 2240/30* (2013.01); *Y10T 428/24273* (2015.01)

(56) References Cited

U.S. PATENT DOCUMENTS

| | | | | |
|---|---|---|---|---|
| 4,558,566 | A | 12/1985 | Shirakura | |
| 4,984,974 | A * | 1/1991 | Naya et al. | 418/87 |
| 5,051,077 | A | 9/1991 | Yanagisawa | |
| 5,218,817 | A | 6/1993 | Urata | |
| 5,370,512 | A | 12/1994 | Fujitani et al. | |
| 5,614,699 | A | 3/1997 | Yashiro et al. | |
| 5,975,035 | A | 11/1999 | McWhorter | |
| 6,331,103 | B1 * | 12/2001 | Teraoka | 418/181 |
| 6,874,486 | B2 * | 4/2005 | Prior et al. | 418/15 |
| 8,172,039 | B2 | 5/2012 | Park et al. | |
| 2002/0033302 | A1 | 3/2002 | Kaneko et al. | |
| 2006/0243520 | A1 * | 11/2006 | Hertenstein et al. | 417/312 |
| 2008/0168961 | A1 * | 7/2008 | Prior et al. | 418/206.1 |
| 2010/0269797 | A1 * | 10/2010 | Prior | 418/201.1 |
| 2011/0300014 | A1 | 12/2011 | Huang et al. | |
| 2012/0020824 | A1 | 1/2012 | Huang et al. | |
| 2012/0237378 | A1 | 9/2012 | Huang et al. | |
| 2013/0247849 | A1 | 9/2013 | HUANG et al. | |

FOREIGN PATENT DOCUMENTS

| | | | | |
|---|---|---|---|---|
| JP | 03124986 | | 5/1991 | |
| JP | 07332273 | A * | 12/1995 | F04C 29/04 |

* cited by examiner

FIG.2a Suction

FIG.2b Trapping & Transfer

FIG.2c Compression

FIG.2d Discharge

FIG.2e Serial Damping

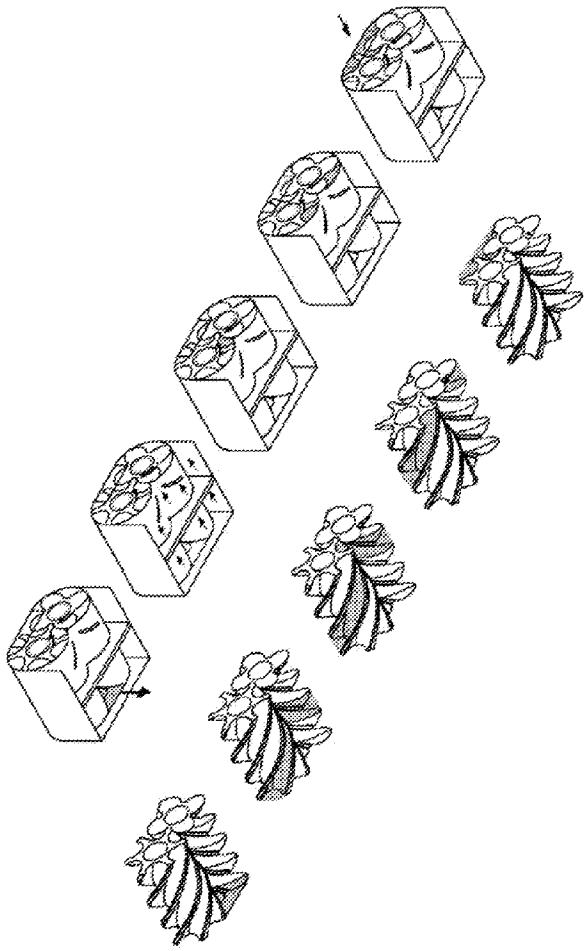
FIG.3a Suction
FIG.3b Trapping & Transfer
FIG.3c Compression
FIG.3d Equalizing
FIG.3e Discharge Orifice Nozzle De Laval Nozzle

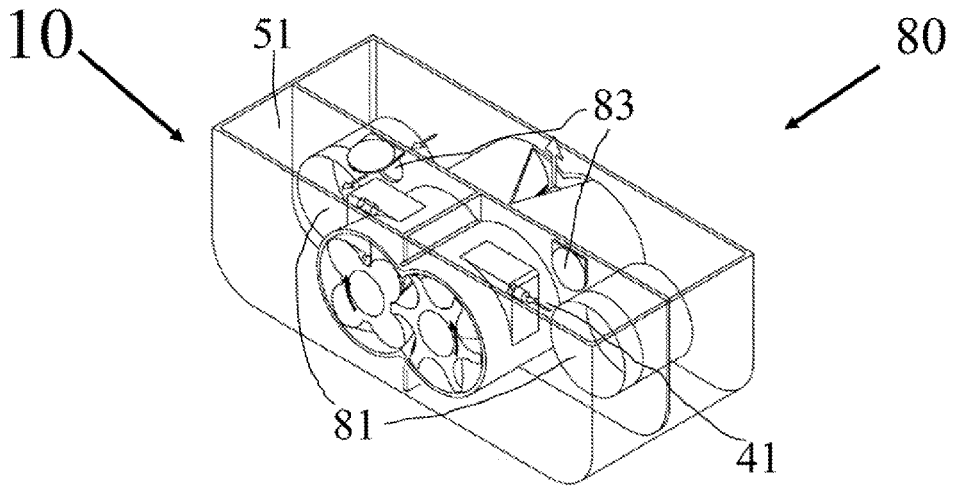
FIG.8
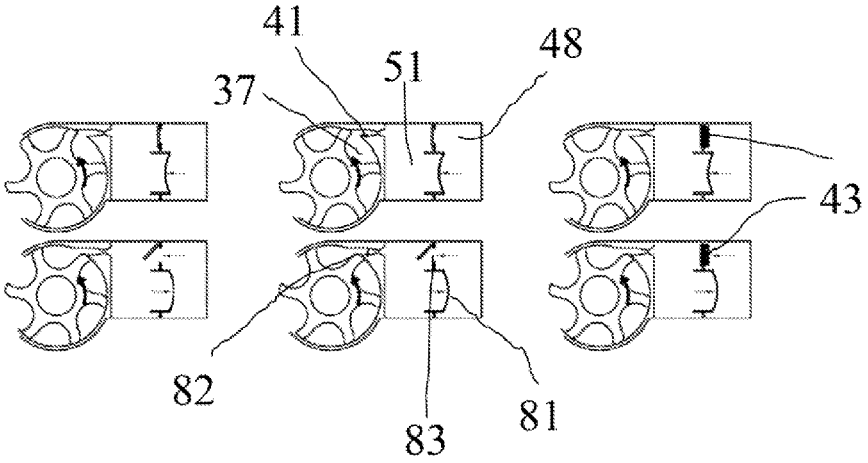
FIG.8a
One Valve
FIG.8b
Two Valves
FIG.8c
No Valve

Rotary Valve
left: open
right: close

Reed Valve
top: close
bottom: open

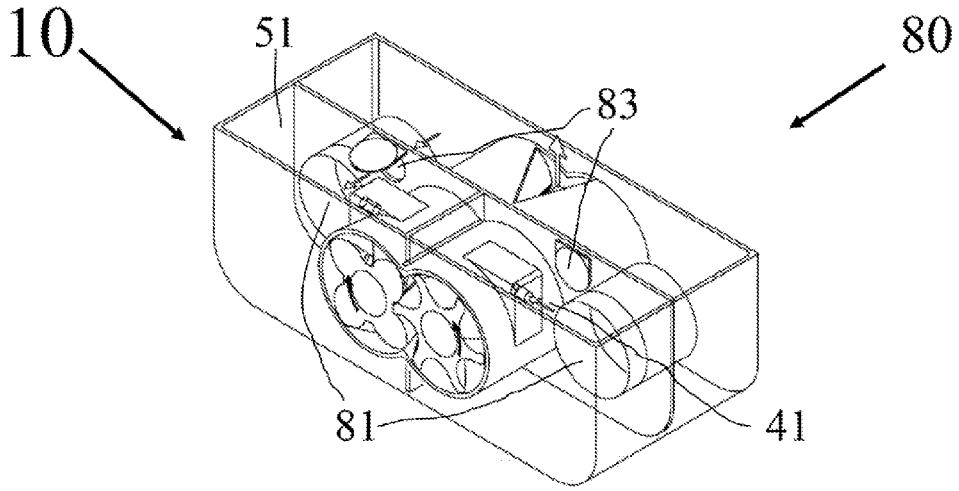
FIG.10
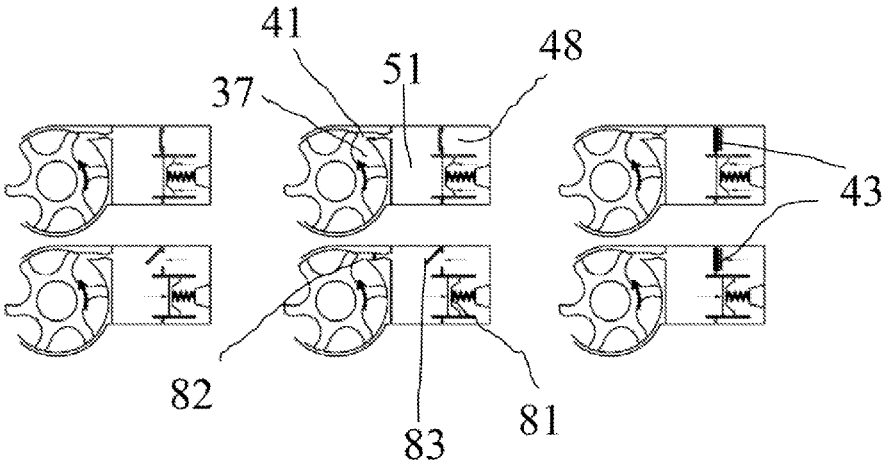
FIG.10a
One Valve
FIG.10b
Two Valves
FIG.10c
No Valve

SCREW COMPRESSOR WITH A SHUNT PULSATION TRAP

CLAIM OF PRIORITY

This application claims priority to Provisional U.S. Patent Application entitled SCREW COMPRESSOR WITH A SHUNT PULSATION TRAP, filed Jan. 5, 2011, having application No. 61/430,139, the disclosure of which is hereby incorporated by reference in its entirety.

BACKGROUND OF THE INVENTION

1. Field of the Invention

The present invention relates generally to the field of rotary blowers or compressors, and more particularly relates to a double rotor helical shaped multi-lobe type commonly known as rotary screw blowers or compressors, and more specifically relates to a shunt pulsation trap for reducing gas pulsations and induced vibration, noise and harshness (NVH), and improving compressor off-design efficiency without using a traditional serial pulsation dampener or a sliding valve.

2. Description of the Prior Art

A rotary screw compressor uses two helical screws, known as rotors, to compress the gas. In a dry running rotary screw compressor, a pair of timing gears ensures that the male and female rotors each maintain precise positions and clearances. In an oil-flooded rotary screw compressor, lubricating oil film fills the space between the rotors, both providing a hydraulic seal and transferring mechanical energy between the driving and driven rotor. Gas enters at the suction side and moves through the threads trapped as the screws rotate. Then the internal trapped volumes between the threads decrease and the gas is compressed. The gas exits at the end of the screws to a discharge dampener to finish the cycle. It is essentially a positive displacement mechanism but using rotary screws instead of reciprocating motion so that displacement speed can be much higher. The result is a more continuous and smoother stream of flow with a more compact size and replacing the traditional reciprocating types.

It has long been known that screw compressors inherently generate gas pulsations with pocket passing frequency at discharge, and the pulsation amplitudes are especially significant under high pressure or for operating conditions of either under-compression or over-compression as being observed in gas transmission or AC and Refrigeration applications. An under-compression happens when the pressure at the discharge opening is greater than the pressure of the compressed gas within the rotor threads just before the opening. This results a rapid backflow of the gas into the threads, a pulsed flow in nature, according to the conventional theory. All fixed pressure ratio compressors suffer from under-compression due to varying system back pressure and a fixed design pressure. An extreme case is the Roots type blower where there is no internal compression at all, or the under-compression is 100% so that gas pulsation constantly exists and pulsation magnitude is directly proportional to pressure rise from blower inlet to outlet. On the other hand, an over-compression takes place when the pressure at the discharge opening is smaller than the pressure of the compressed gas within the rotor threads, causing a rapid forward flow of the gas into the discharge. These pulsations are periodic in nature and very harmful if left undampened that can induce severe vibrations and noise and potentially damage pipe lines and equipments downstream.

To overcome the problem, a large pulsation dampener consisting of a number of chokes and volumes commercially called reactive type, is usually required at the discharge side of a screw compressor to dampen the gas borne pulsations. It is generally very effective in gas pulsation control with a reduction of 20-40 dB but is large in size and causes other problems like inducing more noises due to additional vibrating surfaces, or sometimes induces dampener structure fatigue failures that could result in catastrophic damages to downstream components and equipments. At the same time, discharge dampeners used today create high pressure losses that contribute to poor compressor overall efficiency. For this reason, screw compressors are often cited unfavorably with high gas pulsations, high NVH and low off-design efficiency when compared with dynamic types like the centrifugal compressor.

In addition to the commonly used serial dampening, various other methods, such as skewed porting or using Helmholtz resonators at discharge, have also been attempted throughout the years but with only limited successes. Among the published methods, a flow equalizing strategy is most widely used, for example, as first disclosed in U.S. Pat. No. 4,215,977 to Weatherston, and later in U.S. Pat. No. 5,051,077 to Yanagisawa (Ebara). The idea, say for under-compression as an example, is to feed back a portion of the outlet gas through a skewed discharge opening or a pre-opening port to the compressor chamber prior to discharging to the outlet, thereby gradually increasing the gas pressure inside the cavity, hence reducing discharge pressure spikes when compared with a sudden opening at discharge. However, its effectiveness for gas pulsation attenuation is limited in practice, only achieves 5-10 dB reduction, not enough to eliminate discharge dampener. Moreover, at the off-design conditions, say either an under-compression or an over-compression, compressor efficiency suffers too. The traditional method is to use a sliding valve so that internal volume ratio or compression ratio can be adjusted to meet different system pressure requirements. These systems typically are very complicated structurally with high cost and low reliability.

It is against this background that prompts the present invention to use a different approach based on a new gas pulsation theory that a combination of large amplitude waves and induced fluid flow are the primary cause of high gas-borne pulsations and low efficiency under off-design conditions.

The new gas pulsation theory is based on a well studied physical phenomenon as occurs in a classical shock tube (invented in 1899) where a diaphragm separating a region of high-pressure gas from a region of low-pressure gas inside a closed tube. As shown in FIG. 1*a*-1*b*, when the diaphragm is suddenly broken, a series of high amplitude expansion waves is generated propagating from the low-pressure to the high-pressure region at the speed of sound, and simultaneously a series of high amplitude pressure waves which quickly coalesces into a shockwave is propagating from the high-pressure to the low-pressure region at a speed faster than the speed of sound. An interface, also referred to as the contact surface that separates low and high pressure gases, follows at a lower velocity after the lead wave. Further compression is achieved by the reflected shock wave at the end wall of the low pressure region to the level very close to the initial high pressure. By analogy, the sudden opening of the diaphragm separating high and low pressure is just like the sudden opening of compression cell to discharge gas at off-design conditions.

To understand gas pulsation generation mechanism in light of the shock tube theory, let's review a cycle of a classical screw compressor as illustrated from FIGS. 2*a* to 2*e* by following one flow cell marked dark in a typical 4×6 lobe configuration. In FIGS. 2*a*, low pressure gas first enters the spaces between lobes of a pair of rotors axially as they are open to inlet during their outward rotation from inlet to outlet. At lobe position shown in FIG. 2*b*, gas becomes trapped between two lobes and compressor inner casing as it is transported from inlet to outlet. It is then being compressed as the trapped volume between the threads decrease as shown in FIG. 2*c*. FIG. 2*d* shows the compressed gas is suddenly opened to the outlet and discharged. A serial dampener is then employed to attenuate pulsations generated in the gas stream as shown in FIG. 2*e*.

According to the conventional backflow theory, a backflow would rush into the cell compressing the gas inside as soon as the cell is opened to the discharge as in case of under-compression. Since it is almost instantaneous and there is no volume change taking place inside the cell, the compression is regarded as a constant volume process, or iso-choric. After the compression, the rotors continue to move against this full pressure difference, meshing out the compressed gas to outlet chamber and return to inlet suction position to repeat the cycle.

However, according to the shock tube theory, the cell opening phase as shown in FIG. 2*c* resembling the diaphragm bursting of a shock tube as shown in FIG. 1 *b* would generate a series of shock wave, expansion waves and induced flow. The shock wave front sweeps through the low pressure gas inside the cell and compresses it at the same time at a speed faster than the speed of sound as in case of the under-compression. While for the over-compression, a fan of expansion waves would sweep through the high pressure gas inside the cell and expand it at the same time at the speed of sound. This results in an almost instantaneous adiabatic wave compression or expansion well before the induced flow interface (backflow as in conventional theory) could arrive because wave travels much faster than the fluid, as illustrated by the wave propagation pattern in FIG. 2*f*-2*g*. In this view, the pressure waves or shock waves are the primary driver for the compression as in case of under-compression while the backflow is simply an induced flow behind the shockwave after compression takes place.

In view of the new theory in case of an under-compression, as the shockwave travels to low pressure cell as shown in FIG. 2*f*, a simultaneously generated expansion front travels in the opposite direction causing rapid pressure reduction and inducing backflow down-stream. On the other hand for the case of an over-compression, as the expansion wave travels to high pressure cell as shown in FIG. 2*g*, a simultaneously generated pressure wave front travels in the opposite direction causing rapid pressure increase in the pipe and inducing forward flow down-stream. It is this fast changing pressure at wave front by the speed of sound drives the pulsating flow and is the source of gas pulsation for a screw compressor. Any effective pulsation control should address these fast travelling large amplitude waves and induced flow while minimizing losses at the same time.

Based on this view, having a pre-opening before discharge as suggested by Weatherston or Yanagisawa could reduce gas pulsations by elongating releasing time. However, it failed to recognize hence attenuate the simultaneously generated expansion or shock waves at the opening that eventually travel down-stream unblocked, causing high gas pulsations. Moreover, the prior art failed to address the high flow losses associated with the high induced velocity through the serial dampener or discharging process, resulting in a low compressor off-design efficiency.

Accordingly, it is always desirable to provide a new design and construction of a screw compressor that is capable of achieving high gas pulsation and NVH reduction at source and improving compressor off-design efficiency without externally connected silencer at discharge or using a sliding valve while being kept light in mass, compact in size and suitable for high efficiency, variable pressure ratio applications at the same time.

SUMMARY OF THE INVENTION

Accordingly, it is an object of the present invention to provide a screw compressor with a shunt pulsation trap in parallel with the compressor chamber for trapping and thus reducing gas pulsations and the induced NVH close to pulsation source.

It is a further object of the present invention to provide a screw compressor with a shunt pulsation trap so that it is as efficient as a variable internal volume ratio design but with a simpler structure and higher reliability.

It is a further object of the present invention to provide a screw compressor with a shunt pulsation trap as an integral part of the compressor casing so that it is compact in size by eliminating the serially connected dampener at discharge.

It is a further object of the present invention to provide a screw compressor with a shunt pulsation trap that is capable of achieving reduced gas pulsations and NVH in a wide range of pressure ratios.

It is a further object of the present invention to provide a screw compressor with a shunt pulsation trap that is capable of achieving higher gas pulsation attenuation in a wide range of speeds and cavity passing frequency.

It is a further object of the present invention to provide a screw compressor with a shunt pulsation trap that is capable of achieving the same level of adiabatic off-design efficiency in a wide range of pressure and speed without using a variable geometry like a sliding valve.

BRIEF DESCRIPTION OF THE DRAWINGS

Referring particularly to the drawings for the purpose of illustration only and not limited for its alternative uses, there is illustrated:

FIGS. 2*a* to 2*e* show the compression cycle of a classical 4×6 lobed screw compressor and FIGS. 2*f* and 2*g* are an exploded view of FIG. 2*d* showing the trigger mechanism of gas pulsation generation for a under-compression and an over-compression condition;

FIGS. 3*a* to 3*e* show the new compression cycle of a 4×6 lobed screw compressor with a shunt pulsation trap and FIGS. 3*f* and 3*g* are an exploded view of FIG. 3*d* showing the trigger mechanism of gas pulsation generation for a under-compression and an over-compression condition;

FIGS. 8, 8*a*, 8*b* and 8*c* show a perspective and cross-sectional side views of another alternative embodiment of the shunt pulsation trap with a diaphragm as a dampener and gas pump;

FIGS. 10, 10*a*, 10*b* and 10*c* show a perspective and cross-sectional side views of yet another alternative embodiment of the shunt pulsation trap with a piston as a dampener and gas pump;

DETAILED DESCRIPTION OF THE PREFERRED EMBODIMENT(S)

Although specific embodiments of the present invention will now be described with reference to the drawings, it should be understood that such embodiments are examples only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

It should also be pointed out that though drawing illustrations and description are devoted to a dual rotor screw compressor with a 4×6 lobed configuration for controlling gas pulsations from the under-compression mode in the present invention, the principle can be applied to other rotor combinations such as a single rotor screw or a tri-rotor screw, or lobe combinations like 2×4, 3×4, 3×5, 5×6, etc. The principle can also be applied to other media such as gas-liquid two phase flow as used in AC or refrigeration. The same mechanism is also true for over-compression mode. In addition, screw expanders are the above variations too except being used to generate shaft power from a media pressure drop.

Figure 1A:
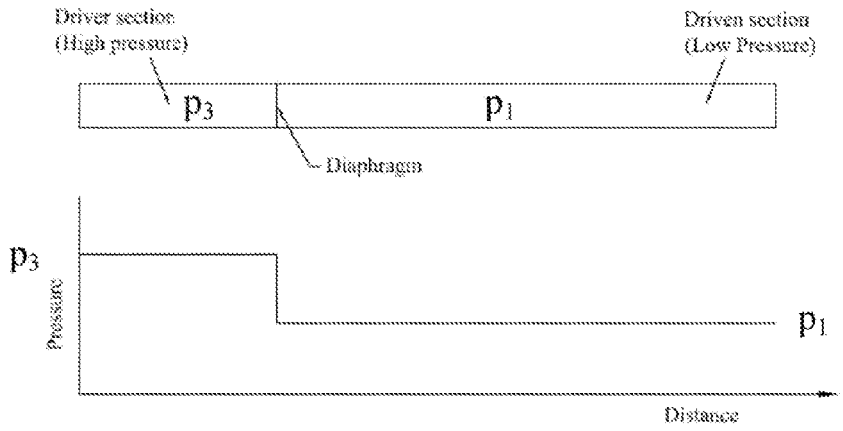
FIG. 1 shows a shock tube device and pressure and wave distribution before and after the diaphragm is broken.
Figure 1B:
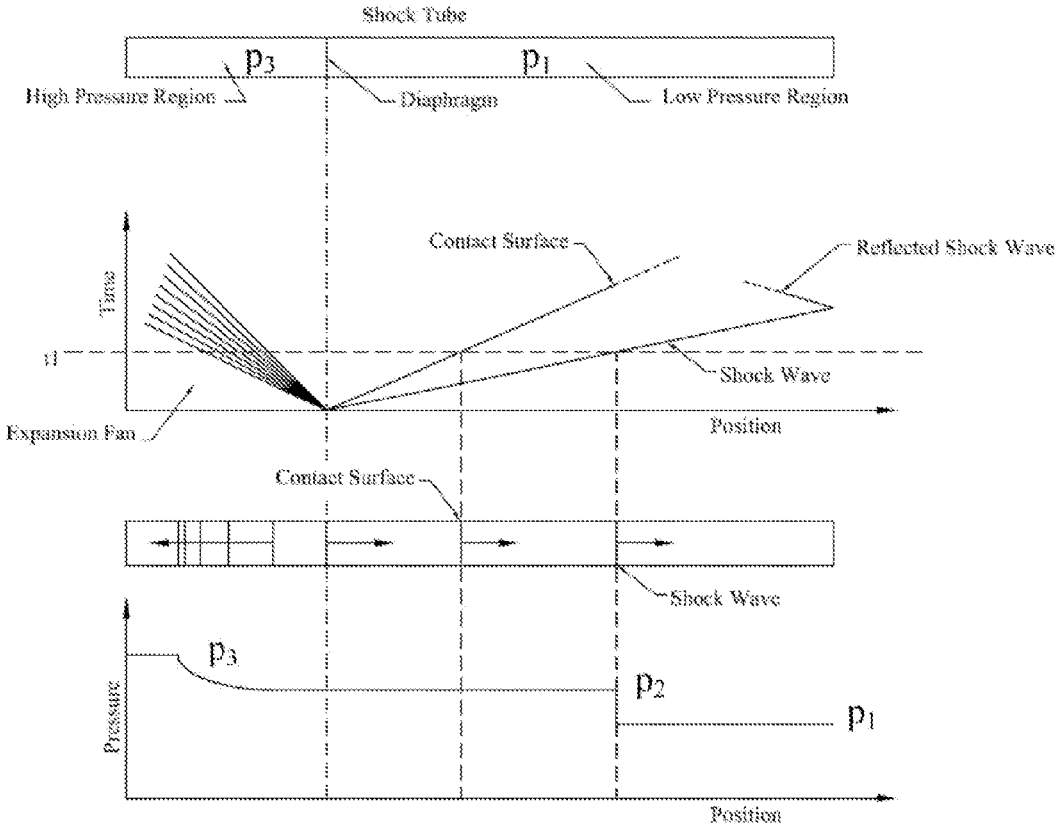
Figure 2F:
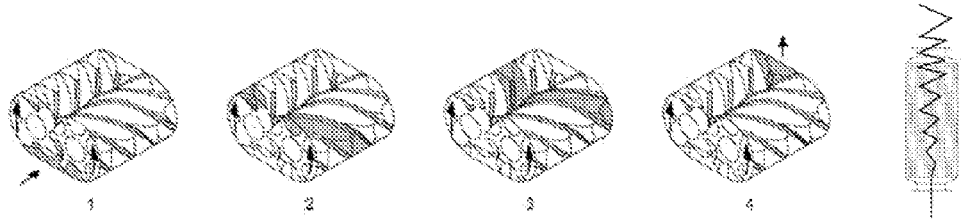
Figure 2F:
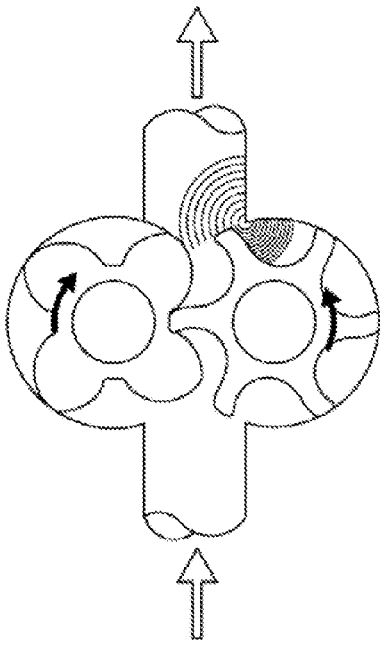
Figure 2G:
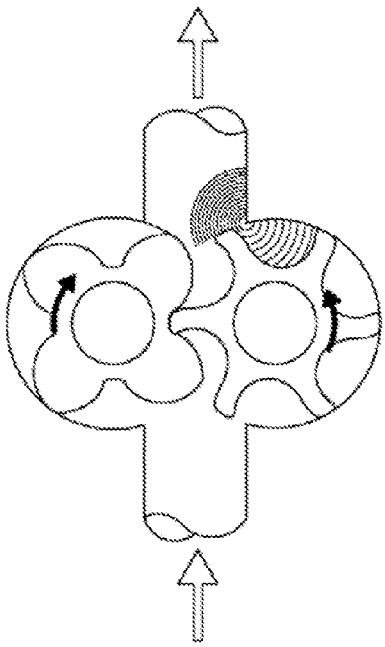
Figure 3F:
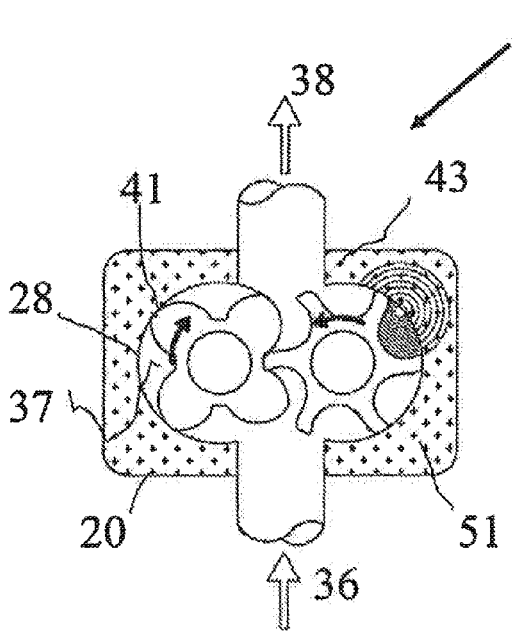
Figure 3G:
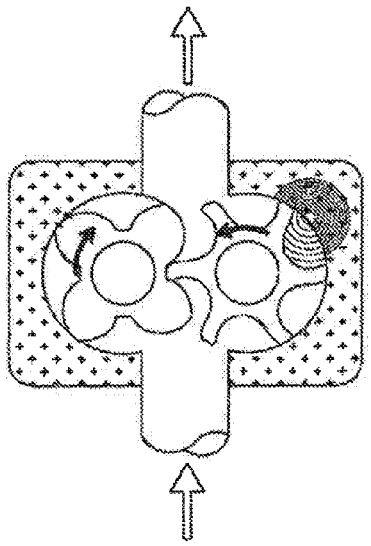

As a brief introduction to the principle of the present invention, FIGS. 3*a* to 3*e* show again a complete cycle of a screw compression for a 4×6 lobed compressor but with the addition of a shunt (parallel) pulsation trap of the present invention right before the compression phase finishes but well before discharge phase starts. In broad terms, pulsation traps are used to trap and to attenuate gas pulsation in order to reduce gas borne pulsations before discharging to downstream applications or releasing to atmosphere. Discharge dampener is one type of pulsation trap (traditional type) which is connected in series with the compressor discharge and through which both fluid flow and pulsation waves pass. The shunt pulsation trap is another type of pulsation trap but connected in parallel with the compression cell. As illustrated in FIGS. 3*a*-3*c*, the phases of flow suction, trapping and compression are still the same as those shown in FIGS. 2*a*-2*c*. But just before compression phase finishes and discharge phase begins as the conventional screw compressor, a new pressure equalizing (dampening) phase is added in between by subjecting the compressed gas cell to a pre-opened injection port, called pulsation trap inlet, just before the compressor discharge port (In theory, pre-opening can be added at any position during compression phase). The injection post is branched off from the compressor chamber into the pulsation trap as a parallel chamber that is also communicating with the compressor outlet through a feedback region called trap outlet. Between injection and feedback region and within pulsation trap, there exists a pulsation dampening device (which can additionally or alternatively operate to provide pulsation energy recovery or containment or both), to control pulsation energy before it travels to the outlet region. As shown in FIG. 3*f*, a series of waves is produced as soon as the compressed gas cell is opened to the trap inlet due to a pressure difference between the pulsation trap (relates to compressor outlet pressure) and compressed gas cell (relates to compressor cell pressure) if there exists an under-compression condition. The generated pressure waves or shockwaves travel to the low pressure side equalizing the gas pressure inside the cell, and at the same time, the simultaneously generated expansion waves on high pressure side, together with part of reflected shockwaves, are entering the pulsation trap, and therein are being attenuated. Because waves travel at a speed about 5-10 times faster than the rotor tip speed, the pressure equalization and attenuation are well under way even before the compressed cell reaches the outlet, hence discharging a pulsation-free gas in an under-compression condition. After the pressure equalizing (dampening) phase, the two screw rotors will mesh out the pulse-free compressed gas to compressor outlet and return to inlet suction position to repeat the cycle, as shown in discharge phase in FIG. 3*e*. The same principle applies to an over-compression condition but with reversed wave patterns as shown in FIG. 3*g*.

The principal difference with conventional screw compressor is in compression and dampening phase: instead of waiting and delaying the dampening action after discharge by using a serially-connected dampener, the shunt pulsation trap would start dampening before discharge by inducing pulsations into the parallel positioned trap. It then dampens the pulsations within the trap simultaneously as the compressed gas cell travels to the outlet. In this process, the gas compression and pulsation attenuation are taking place in parallel instead of in series as in a conventional screw compressor.

There are several advantages associated with the parallel pulsation trap compared with a traditional serially connected dampener. First of all, pulsation attenuation is separated from the main cell flow so that an effective attenuation will not affect the losses of the main flow cell, resulting both in a higher compression off-design efficiency and attenuation efficiency. In a traditional serially connected dampener, both gas pulsations and fluid flow travel together through the dampener where a better attenuation always comes at a cost of higher flow losses. So a compromise is often made in order to reduce flow losses by sacrificing the degree of pulsation dampening or having to use a very large volume dampener in a serial setup.

Secondly, the parallel pulsation trap attenuates pulsations much closer to pulsation source than a serial one and is capable of employing a more effective pulsation dampening means without affecting main flow efficiency. It can be built as an integral part of the compressor casing in a conforming shape, resulting in a much smaller size and footprint, hence less weight and cost. By replacing the traditional serially connected dampener or silencer with an integral paralleled pulsation trap, compressor package will be compact in size which also reduces noise radiation surfaces and is especially suitable for mobile applications.

Moreover, the pulsation trap can be so constructed that its inner casing is an integral part of the outer casing of the compressor chamber, and the outer casing are oversized surrounding the inner casing, resulting in a double-walled structure enclosing the noise source deeply inside the core with a much smaller noise radiation surface. The casings could be made of a casting that would be more absorptive, thicker and more rigid than a conventional sheet-metal dampener silencer casing, thus less noise radiation.

With an integrally built pulsation trap, the compressor outer casing would be structurally more rigid and resistant to stress or thermal related deformations. At the same time, the double-wall casing tends to have a more uniform temperature distribution inside the pulsation trap so that the traditional casing distortion can be kept to minimum, thus reducing internal clearances and leakages, resulting in higher compressor efficiency.

Referring to FIG. 4, there is shown a typical arrangement of a preferred embodiment of a screw compressor 10 with a shunt pulsation trap apparatus 50. Typically, the screw compressor 10 has two parallel rotors 12 mounted on two rotor shafts respectively (not shown), where rotor shaft driven by an external rotational driving mechanism (not shown) and either through a set of timing gears in case of dry running or drives each other directly for oil injected case, for propelling flow from a suction port 36 through a compressor chamber 37 to a discharge port 38 of the compressor 10. The screw compressor 10 also has an inner casing 20 as an integral part of the compressor chamber 37, wherein rotor shafts are mounted on an internal bearing support structure (not shown). The casing structure further includes an outer casing 28 with a space maintained between the inner casing 20 and the outer casing 28 forming the pulsation trap chamber 51. The multi-helical-lobe rotors 12 define axially serial lobe spans, and the trap inlet 41 is positioned at least one lobe span away from the flow suction port 36 ("one lobe span from suction port 36" means that the incoming flow being compressed is just isolated from or stops communicating with the flow suction port 36).

Figure 4A:
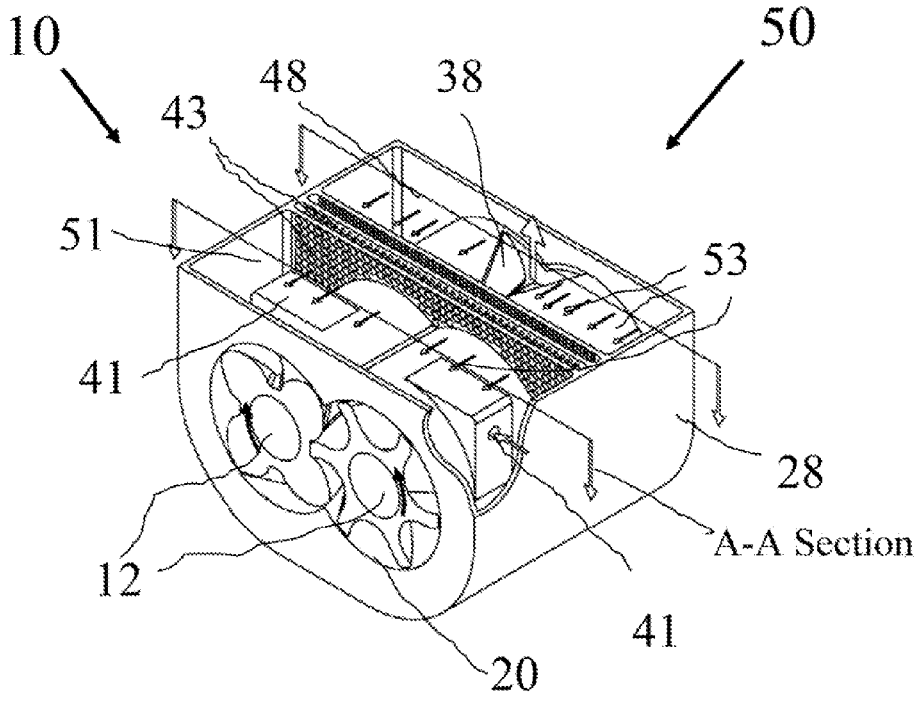
FIG. 4*a* shows a perspective view of a preferred embodiment of the shunt pulsation trap and FIG. 4*b* is a cross-sectional view of (A-A) section on FIG. 4*a* showing different shapes of preferred injection port nozzles.
Figure 4B:
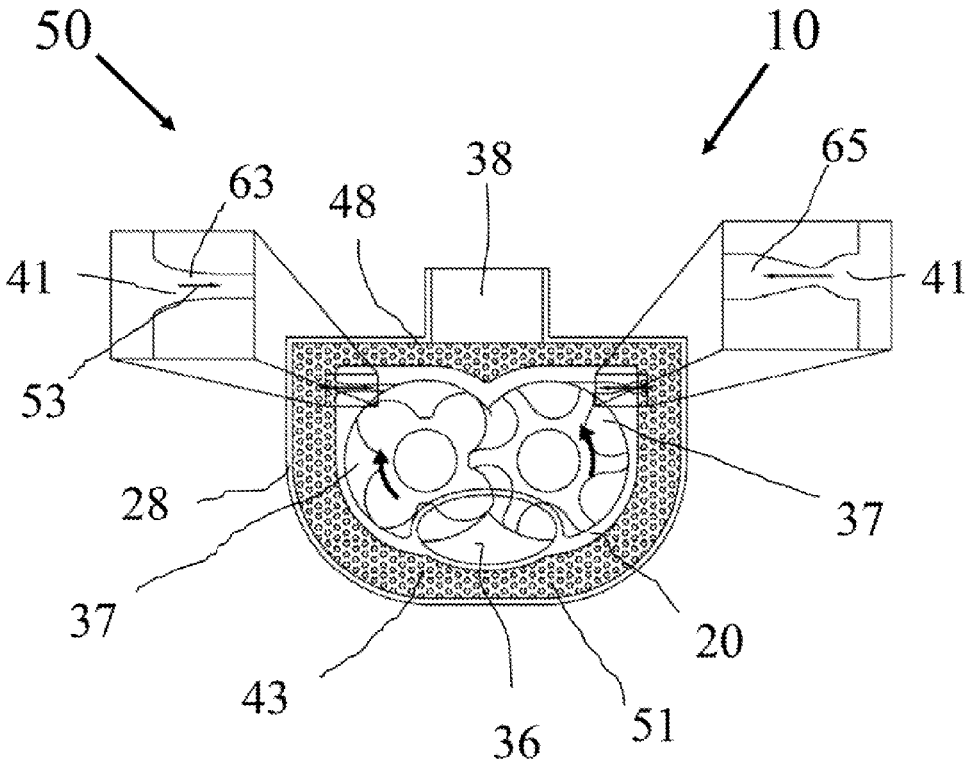

As an important novel and unique feature of the present invention, a shunt pulsation trap apparatus 50 is conformingly surrounding the screw compressor 10 of the present invention, and its cross-section is illustrated in FIG. 3*f*-3*g* and FIG. 4*b*. In the embodiment illustrated, the shunt pulsation trap apparatus 50 is further comprised of an injection port (trap inlet) 41 branching off from compressor chamber 37 into the pulsation trap chamber 51 and a feedback region (trap outlet) 48 communicating with the compressor outlet 38, therein housed pulsation dampening device 43. As rotor tip passes over the trap inlet 41 as shown for the right rotor in FIG. 3*f*, a series of pressure waves are generated at trap inlet 41 going into the compressor chamber 37 inducing a feedback flow 53. Simultaneously a series of expansion waves are generated at trap inlet 41, but travelling in a direction opposite to the feedback flow, that is: from trap inlet 41, going through dampener 43 before reaching trap outlet 48 and compressor outlet 38. In FIG. 4, the large arrows show the direction of rotation and main flow cells as propelled by the rotors 12 from the suction port 36 to the discharge port 38 of the compressor 10, while feedback flow 53 as indicated by the small arrows goes from the feedback region (trap outlet) 48 through the dampener 43 into the pulsation trap chamber 51, then converging to the injection port (trap inlet) 41 and releasing into the compressor chamber 37.

When a screw compressor 10 is equipped with the shunt pulsation trap apparatus 50 of the present invention, there exist both a reduction in the pulsation transmitted from screw compressor to compressor downstream flow as well as an improvement in internal flow field (hence its adiabatic off-design efficiency) for an under-compression case.

The theory of operation underlying the shunt pulsation trap apparatus 50 of the present invention is as follows. As illustrated in FIG. 3*a* to FIG. 3*g* and also refer to FIG. 4, phases of flow suction, transfer and compression are still the same as those shown in FIGS. 2*a*-2*c* of a conventional screw compressor. But just before compression phase finishes, instead of being opened to compressor outlet 38 as the conventional screw compressor does, the compressed flow cell inside the compressor chamber 37 is pre-opened to injection port (or trap inlet) 41 before discharge port 38 opens. As shown in FIG. 3*f*, a series of pressure waves or shock waves are produced due to a pressure difference between the pulsation trap chamber 51 (close to outlet pressure) and compressor chamber 37 (close to compressed cell pressure) as in the case of the under-compression. The pressure waves traveling into the compressor chamber 37 compress the trapped gas inside, but at the same time, an accompanying expansion wave and a small portion of reflected pressure waves or shock waves enter the pulsation trap chamber 51, and therein are being stopped and attenuated by dampening device 43. To improve pulsation absorbing rate, acoustical absorption materials or other similar types for turning pulsation into heat, can be used either inside pulsation trap chamber 51 or lining its interior walls (not shown). Because waves travel at a speed about 5-10 times faster than the rotor 12 tip speed, the compression and attenuation are well under way even before the screw tip reaches the compressor outlet opening 38, hence discharging a pulsation-free gas stream.

Figures 6A, 6B, 6C:
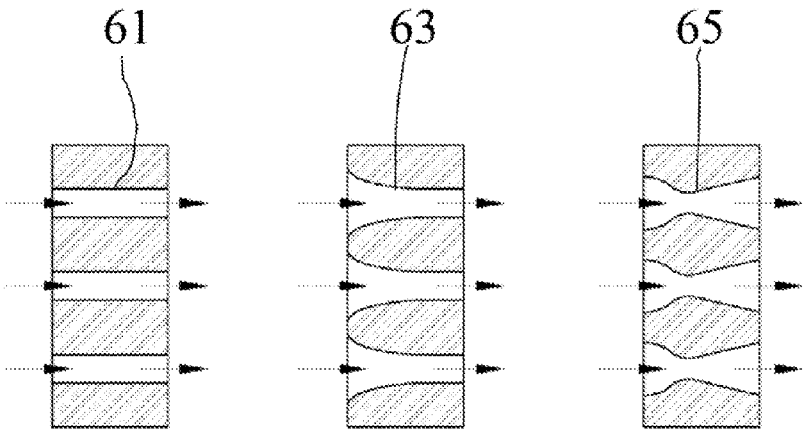
FIG. 6 is a cross-sectional view of different hole shapes of a perforated plate of the shunt pulsation trap.

FIG. 4*a* shows a shunt pulsation trap with at least one layer of perforated plate 43 as dampening device. The perforated plate 43 is located within the pulsation trap chamber 51 between the trap inlet 41 and the trap outlet 48. While waves are trapped by plate 43 inside the pulsation trap chamber 51 where it is being dampened, feedback flow 53 is allowed to go through the pulsation trap 51 unidirectionally from trap outlet 48 to trap inlet 41 through perforated plate 43 at high velocity. To reduce the feedback flow loss that is high for constant area shaped holes 61 of the perforated plate 43, an alternative converging cross-sectional shaped flow nozzle 63 or de Laval converging-diverging cross-sectional shaped nozzle 65 can be used, as shown in FIGS. 6*b*-*c* and 4*b*, thus improving feedback flow efficiency compared to a traditional screw compressor at under-compression conditions. The same is true at the trap inlet 41 where the feedback flow velocity can be so high to be "choked" as pressure ratio across reaches 1.89, seriously limiting feedback flow capacity and creating losses. So using a nozzle 63 or de Laval nozzle 65, as shown in FIG. 4*b*, would improve injection flow rate and off-design efficiency compared to a traditional orifice shape so that compressor overall adiabatic efficiency is greatly increased. In addition, by getting rid of the serially connected silencer dampening the main discharge flow, the associated dampening losses are eliminated for the main cell flow, further increasing compressor efficiency.

Moreover, the hot feedback flow 53 sandwiched between the cored and integrated inner casing 20 and outer casing 28 acts like a water jacket of a piston cylinder in an internal combustion engine, tending to equalize temperature difference between the cool inlet port 36 and hot outlet port 38. This would lead to less thermal distortion of the inner casing 20, which in turn would decrease the internal clearances and improve efficiency.

Figure 5A:
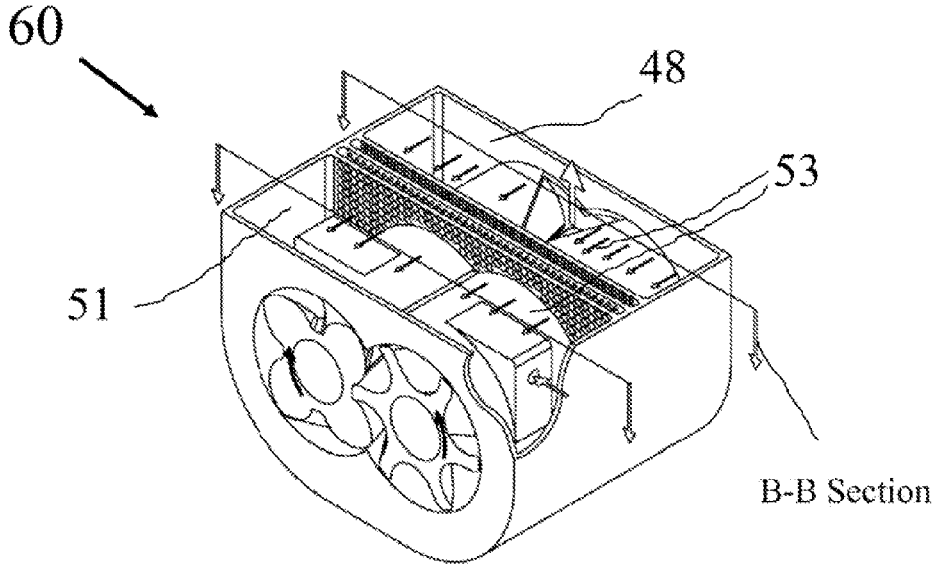
FIG. 5*a* shows a perspective view of an alternative embodiment of the shunt pulsation trap and FIG. 5*b*-5*c* is a cross-sectional view of (B-B) section on FIG. 5*a* showing an additional wave reflector either after or before the feedback port.
Figure 5B:
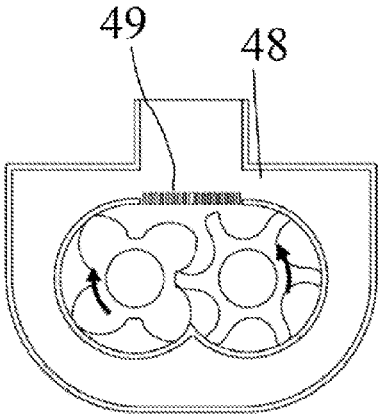
Figure 5C:
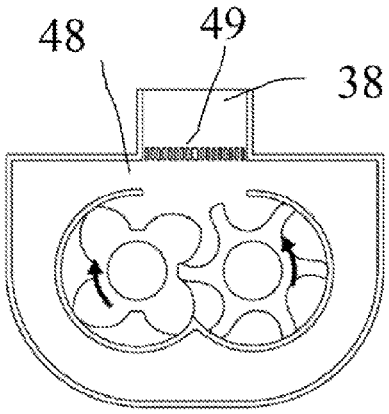

FIG. 5 shows a typical arrangement of an alternative embodiment of the screw compressor 10 with a shunt pulsation trap apparatus 60. In this embodiment, another perforated plate 49 acting as a wave reflector and a dampener is added to the preferred embodiment as an additional dampening device of the pulsation trap 60. FIG. 5*b* and FIG. 5*c* show wave reflector (i.e., perforated-plate dampening device) 49 is located before or after feedback region (trap exit) 48 respectively. In theory, a wave reflector is a device that would reflect waves while let fluid go through without too much losses. In this embodiment, the leftover residual pulsations either from the compression chamber 37 or coming out of pulsation trap outlet 48 or both could be further contained and prevented from traveling downstream causing vibrations and noises, thus capable of achieving more reductions in pulsation and noise but with additional cost of the perforated plate and some associated losses. With the feedback flow 53 going through the pulsation trap 51, the main discharge cell flow is unidirectional through the discharge wave reflector 49 as shown in FIG. 5*b* without flow reversing losses and the associated dampening losses are greatly reduced too by using perforated holes with shape of either a flow nozzle 63 or de Laval nozzle 65 as shown in FIG. 6, thus improving flow off-design efficiency at discharge compared to a traditional screw compressor.

Figure 7:
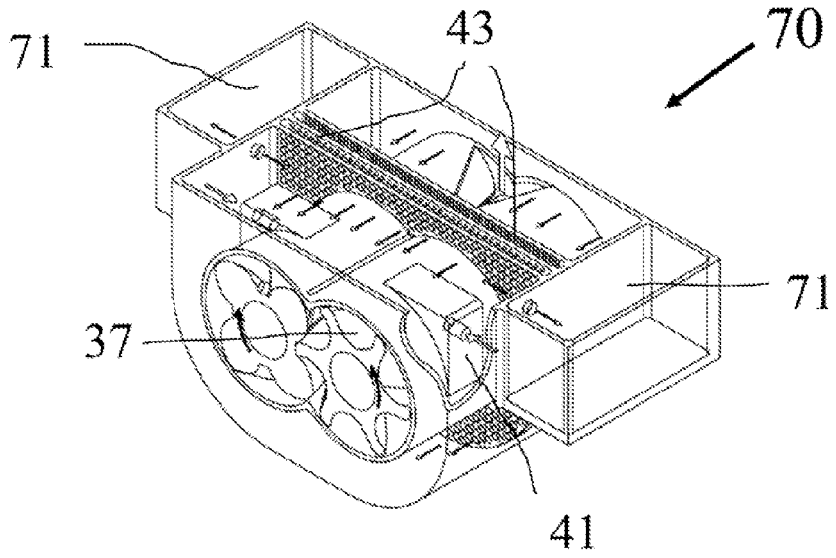
FIG. 7 is a perspective view of another alternative embodiment of the shunt pulsation trap with Helmholtz resonators.

FIG. 7 shows a typical arrangement of yet another alternative embodiment of the screw compressor 10 with a shunt pulsation trap apparatus 70. In this embodiment, Helmholtz resonators 71 are used as an alternative pulsation dampening device supplementing the pulsation trap 70. In theory, Helmholtz resonators could reduce specific undesirable frequency pulsations by tuning to the problem frequency thereby eliminating it. Since the screw compressor generates a specific pocket passing frequency pulsation when running at fixed speed and a Helmholtz resonator could be tuned to that specific frequency for elimination. In this embodiment, the pulsations generated at trap inlet 41 would be treated by Helmholtz resonator 71 located close to trap inlet 41 and in parallel with dampener 43. It could also be used alone or in multiple numbers or different sizes.

Figure 9A:
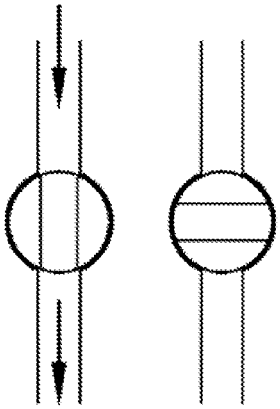
FIGS. 9*a* and 9*b* show a cross-sectional view of a rotary valve and a reed valve in open and close positions.
Figure 9B:
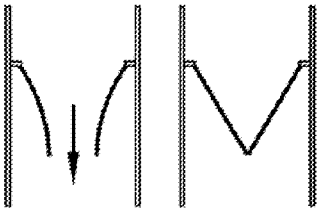

FIGS. 8-10 show some typical arrangements of yet another alternative embodiment of the screw compressor 10 with a shunt pulsation trap apparatus 80. In this embodiment, a diaphragm or a piston 81 is used as an alternative pulsation dampening device (additionally providing for energy recovery) for pulsation trap 80. FIG. 8*a* shows a one-valve configuration, FIG. 8*b* a two-valve, and FIG. 8*c* a configuration with a dampener in place of the one-valve. In FIG. 8, the top view shows a charging (dampening) phase with only the trap inlet 41 and valve 82 open to the compressor chamber 37 while the trap outlet 48 and valve 83 are closed. In the same way, the bottom view shows a discharging (pumping) phase with the trap inlet 41 and valve 82 closed to the compressor chamber 37 while the trap outlet 48 and valve 83 open. The valves 82/83 used could be any types that are capable of being controlled and timed in the fashion as described above, and one example is given in FIG. 9 for a rotary valve and a reed valve. In operation, as an example shown in FIG. 8*b* again for under-compression, a series of waves are generated as soon as the rotor tip pass over the pulsation trap inlet 41 during charging phase. The pressure waves would travel into the compressor chamber 37 while the accompanying expansion waves enter the pulsation trap chamber 51 in opposite direction. Because of the pressure difference between the pulsation trap chamber 51 (close to outlet pressure) and compressor chamber 37 (close to compressed cell pressure), the diaphragm 81 would be pulled towards the trap inlet 41 by the pressure difference hence absorbing the pulsation energy and storing it with the deformed diaphragm 81 (charged). At this time, the valve 83 located at the trap outlet 48 is closed, effectively sealing the waves within the pulsation trap chamber 51. As the rotor moves further and pressure difference is diminishing as shown in the bottom view of FIG. 8*b*, the diaphragm 81 would be pulled away from the trap inlet 41 by the stored spring energy, resulting in a pumping action sucking gas in from the now opened valve 83, building up the pressure again in the pulsation trap chamber 51 while trap inlet valve 82 is kept closed at this time. By alternatively open and close valves 82 and 83 in a synchronized way timed with the screw rotor and diaphragm positions, the pulsation energy could be effectively absorbed and re-used to keep the cycle going while the waves within the trap is kept contained and attenuated, resulting in a pulse-free gas with minimal energy losses.

FIG. 10 is similar to FIG. 8 except using a piston instead of a diaphragm as a dampening device.

Figure 11A:
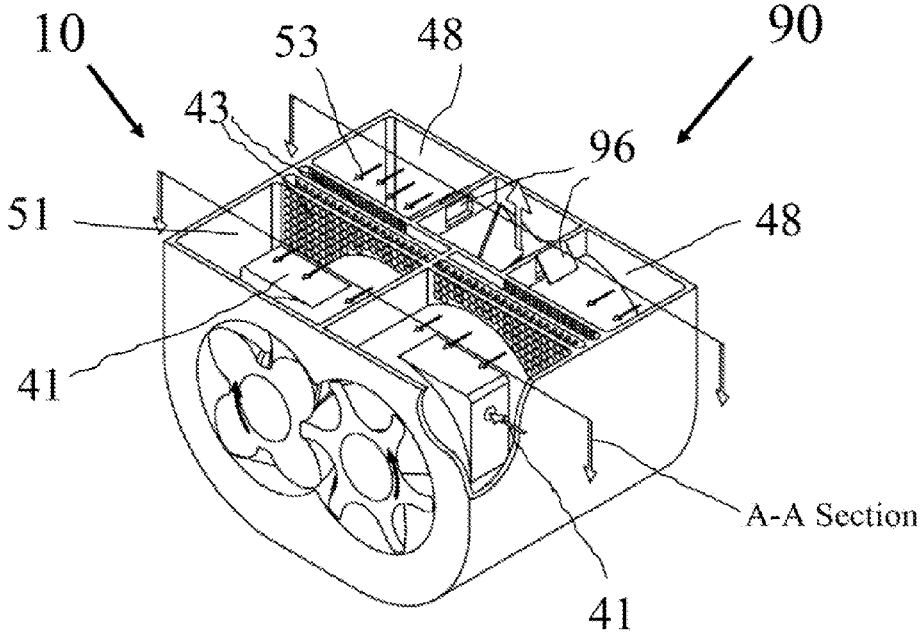
FIG. 11*a* shows a perspective view of an alternative embodiment of the shunt pulsation trap with a valve at trap outlet and FIG. 11 *b* is a cross-sectional view of (A-A) section on FIG. 11*a*.
Figure 11B:
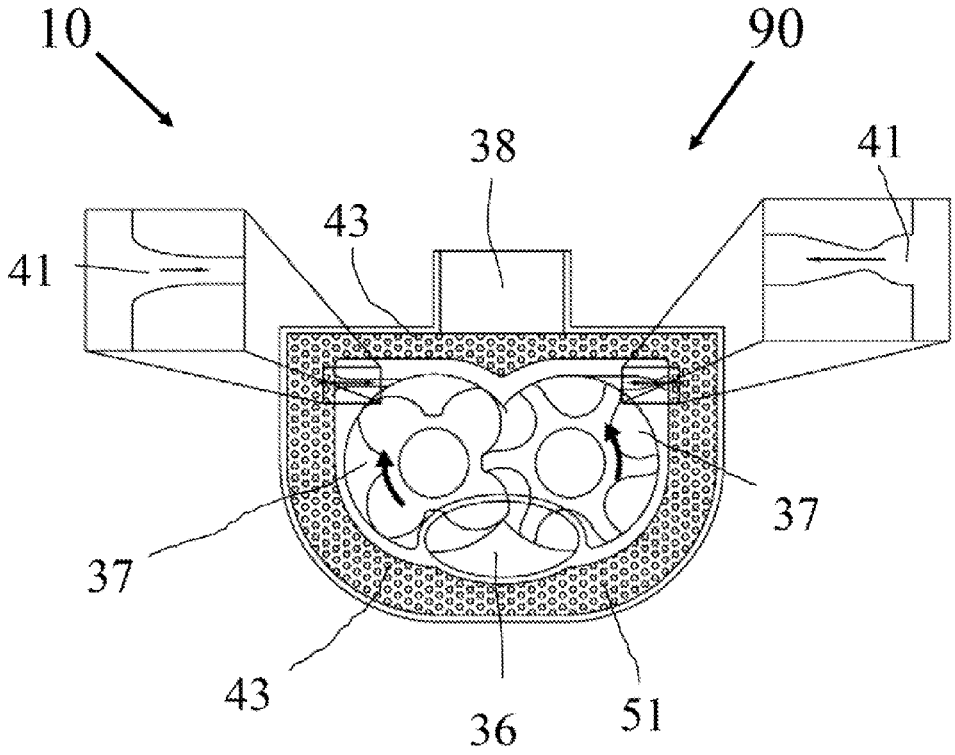

FIG. 11*a* shows a typical arrangement of yet another alternative embodiment of the screw compressor 10 with a shunt pulsation trap apparatus 80*b*. In this embodiment, a control valve 86 is used as pulsation dampening device (also providing for pulsation containment) for pulsation trap 80*b*, one on each side of discharge port 38. In addition, FIG. 11*a* shows a configuration with an optional dampener 43 between trap inlet 41 and control valve 86 located at trap outlet 48. The principle of the operation is taking advantages of the opposite travelling direction of wave and flow inside the pulsation trap 80*b*. By using a directional controlled valve 86 as a dampening device, it would only allow flow in while keeping the waves from going out of the trap in a timed fashion. In FIG. 11*b*, the left rotor shows the wave containment phase with the trap inlet 41 open to the compression chamber 37 while the trap outlet 48 is closed by dampening-device valve 86. In the same way, the right rotor shows a flow-in phase when the compression is finished and the trap outlet 48 is opened through valve 86. The valve 86 used could be any types that are capable of being flow controlled like a reed valve or timed with lobe rotation in a fashion as described above, and one example is given in FIG. 9*a* for a rotary valve. In operation, as an example shown in FIGS. 11*a* and 11*b* again for under-compression, a series of waves are generated as soon as the rotor tip pass over the pulsation trap inlet 41 during isolation phase. The pressure waves would travel into the compression chamber 37 while the accompanying expansion waves enter the pulsation trap chamber 51 in opposite direction. At this time, the valve 86 located at the trap outlet 48 is closed, effectively sealing the waves within the pulsation trap chamber 51 where it is being dampened by an optional dampener 43 inside. As the rotor moves further and pressure difference is diminishing, the valve 86 at trap outlet 48 is opened allowing gas in and building up pressure again in the pulsation trap chamber 51. By alternatively open and close valve 86 in a synchronized way timed with the rotor positions, the waves and pulsation energy could be effectively contained within the trap, resulting in a pulse-free gas to the outlet.

In another embodiment, the pulsation-dampening device includes at least one divider plate with at least one choke inside the trap volume.

It is apparent that there has been provided in accordance with the present invention a screw compressor with a shunt pulsation trap for effectively reducing the high pulsations caused by under-compression or over-compression without increasing overall size of the compressor. While the present invention has been described in context of the specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A screw compressor, comprising:

a. a housing structure having an inner casing with a flow suction port, a flow discharge port, and a compressor chamber there-between;

b. two parallel multi-helical-lobe rotors rotatably mounted on two parallel rotor shafts respectively inside said compressor chamber for propelling flow from said suction port to said discharge port in a flow direction; and c. a shunt pulsation trap apparatus comprising an outer casing oversized and surrounding said inner casing to cooperatively form a pulsation trap chamber therebetween, at least one pulsation dampening device positioned within the pulsation trap chamber, at least one trap inlet branching off from said compressor chamber before said flow discharge port in said flow direction and connecting said compressor chamber to said pulsation trap chamber so that at least a portion of said compressor chamber and said pulsation trap chamber are arranged in parallel, and at least one trap outlet connecting said pulsation trap chamber to said compressor discharge port;

wherein said screw compressor is capable of achieving high gas pulsation and NVH reduction at said pulsation trap chamber and improving compressor off-design efficiency.

2. The screw compressor as claimed in claim 1, wherein said multi-helical-lobe rotors have axially serial lobe spans and said trap inlet is positioned at least one lobe span away from said flow suction port.

3. The screw compressor as claimed in claim 2, wherein said trap inlet has a converging cross-sectional shape or a converging-diverging cross-sectional shape in a feedback flow direction.

4. The screw compressor as claimed in claim 1, wherein said pulsation dampening device comprises at least one layer of perforated plate.

5. The screw compressor as claimed in claim 4, wherein the perforated plate has holes with a cross-sectional shape of a converging shape or a converging-diverging shape in a feedback flow direction.

6. The screw compressor as claimed in claim 1, wherein said pulsation dampening device comprises at least one layer of perforated plate on which there is positioned at least one synchronized valve that is closed and opened as said each lobe passes said trap inlet.

7. The screw compressor as claimed in claim 6, wherein said control valve is a reed valve, another one way valve, or a rotary valve that is timed to close or open as each said lobe passes said trap inlet.

8. The screw compressor as claimed in claim 1, wherein said pulsation dampening device comprises at least one Helmholtz resonator.

9. The screw compressor as claimed in claim 1, wherein said pulsation dampening device comprises at least one Helmholtz resonator in parallel with at least one layer of perforated plate.

10. The screw compressor as claimed in claim 1, wherein said pulsation dampening device comprises at least one Helmholtz resonator in parallel with at least one synchronized valve that is closed and opened as each said lobe passes said trap inlet.

11. The screw compressor as claimed in claim 1, wherein said pulsation dampening device comprises at least one diaphragm or piston in parallel with at least one layer of perforated plate for partially absorbing pulsation energy and turning that energy into pumping gas from said trap outlet through said perforated plate into said trap inlet, for energy recovery.

12. The screw compressor as claimed in claim 1, wherein said pulsation dampening device comprises at least one diaphragm or piston in parallel with an opening for absorbing pulsation energy and directing that energy into pumping gas from said trap outlet through said opening into said trap inlet, for energy recovery.

13. The screw compressor as claimed in claim 1, wherein said pulsation dampening device comprises at least one diaphragm or piston synchronized with at least one valve for absorbing pulsation energy and directing that energy into pumping gas from said trap outlet through said valve into said trap inlet, for energy recovery.

14. The screw compressor valves as claimed in claim 13, wherein said valve is a rotary valve, a reed valve, or a combination of rotary valve and reed valve.

15. The screw compressor as claimed in claim 1, wherein said pulsation trap further comprises at least one perforated plate located at said discharge port and either before or after said trap outlet.

16. The screw compressor as claimed in claim 15, wherein the perforated plate has holes with a cross-sectional shape of a converging shape or a converging-diverging shape in a discharge flow direction.

17. The screw compressor as claimed in claim 1, further comprising a pulsation containment device including at least one control valve located at said trap outlet.

18. The screw compressor as claimed in claim 1, wherein said pulsation containment device comprises at least one layer of perforated plate or acoustical absorption material for turning pulsation into heat, in series with at least one control valve located at said trap outlet.

19. The screw compressor as claimed in claim 1, wherein said pulsation dampening device comprises at least one layer of acoustical absorption material for turning pulsation into heat, either inside said pulsation trap chamber or lining interior walls thereof.

* * * * *